US009516957B2

(12) United States Patent
Riegle

(10) Patent No.: US 9,516,957 B2
(45) Date of Patent: Dec. 13, 2016

(54) JEWELRY CASE WITH MANY VIEWABLE SPACES AND REMOVABLE SECTIONS

(71) Applicant: Pamela B. Riegle, Muncie, IN (US)

(72) Inventor: Pamela B. Riegle, Muncie, IN (US)

( * ) Notice: Subject to any disclaimer, the term of this patent is extended or adjusted under 35 U.S.C. 154(b) by 0 days.

(21) Appl. No.: 15/097,169

(22) Filed: Apr. 12, 2016

(65) Prior Publication Data

US 2016/0296041 A1 Oct. 13, 2016

Related U.S. Application Data

(60) Provisional application No. 62/146,773, filed on Apr. 13, 2015.

(51) Int. Cl.

| | |
|---|---|
| ***A47F 7/02*** | (2006.01) |
| ***A47F 3/00*** | (2006.01) |
| ***A47F 3/10*** | (2006.01) |
| ***A45C 11/16*** | (2006.01) |
| ***A47B 47/00*** | (2006.01) |
| ***A47B 49/00*** | (2006.01) |
| ***A47B 81/00*** | (2006.01) |

(52) U.S. Cl.

CPC ..... *A47F 7/02* (2013.01); *A45C 11/16* (2013.01); *A47B 47/00* (2013.01); *A47B 49/00* (2013.01); *A47B 81/00* (2013.01); *A47F 3/004* (2013.01); *A47F 3/10* (2013.01)

(58) Field of Classification Search

CPC ..... A47F 7/02; A47F 3/10; A47F 3/004; A47F 5/02; A47F 3/005; A47F 7/26; A47B 49/00; A47B 47/00; A47B 88/0485; A47B 46/00; A47B 81/00; A47B 2088/0403; A47B 2210/0056; A47B 2210/0062; A47B 88/04; A45C 11/16; B25H 3/028

USPC ..... 312/126, 289, 321.5, 330.1, 334.24,312/334.28, 283, 131, 132, 129, 286, 162,312/249.2; 206/6.1

See application file for complete search history.

(56) References Cited

U.S. PATENT DOCUMENTS

| | | | | | |
|---|---|---|---|---|---|
| 906,368 | A * | 12/1908 | Barger | A47F 3/10 | 211/70 |
| 1,393,050 | A * | 10/1921 | Talley | A47F 3/10 | 312/135 |
| 2,254,431 | A * | 9/1941 | Levine | A47B 67/02 | 206/364 |
| 4,463,856 | A * | 8/1984 | Strasser | A47F 7/024 | 211/163 |
| 5,207,723 | A * | 5/1993 | Newby, Sr. | B62B 1/12 | 280/47.19 |
| 5,411,139 | A * | 5/1995 | Victory | A47G 29/10 | 206/493 |

(Continued)

*Primary Examiner* — Daniel J Troy
*Assistant Examiner* — Hiwot Tefera
(74) *Attorney, Agent, or Firm* — Ritchison Law Offices, PC; John D Ritchison

(57) ABSTRACT

A jewelry case, easily assembled from a knock-down kit, with viewable spaces and removable sections to display and handle necklaces, bracelets, pendants, rings and the similar jewelry pieces. The case is made of a durable and transparent plastic including a top, back surface, bottom and front surfaces, a pair of end surfaces with apertures, multiple pull out racks having hook assemblies with a way to hold the jewelry, and a container and cubicle drawer for rings, pins, broaches, etc. so that the case may be filled with jewelry for display and storage. The case kit provides a flat, knock-down components package for easy and economical shipping, gifting and storage.

7 Claims, 7 Drawing Sheets

(56) References Cited

U.S. PATENT DOCUMENTS

| | | | | | |
|---|---|---|---|---|---|
| 5,468,063 | A * | 11/1995 | Simonek | A47B 88/0485 | 312/287 |
| 5,590,940 | A * | 1/1997 | Richard | A47B 81/00 | 211/162 |
| 6,074,027 | A * | 6/2000 | Chang | A47B 47/00 | 312/108 |
| 6,253,568 | B1 * | 7/2001 | Peffley | A47B 88/0485 | 312/199 |
| 7,281,634 | B2 * | 10/2007 | Marchetta | A47B 46/00 | 211/94.01 |
| 7,987,988 | B2 * | 8/2011 | Johnson | A45C 11/16 | 206/6.1 |
| 8,944,444 | B1 * | 2/2015 | Tvrdy | B62B 3/005 | 280/47.35 |
| 2006/0103275 | A1 * | 5/2006 | Chang | A45C 11/16 | 312/290 |
| 2009/0008347 | A1 * | 1/2009 | Bell | A45D 44/02 | 211/61 |
| 2014/0346939 | A1 * | 11/2014 | Rickman | A47F 7/02 | 312/334.1 |

* cited by examiner

80

90

30

40

33

80
33A
50
33

80
53
33
34A
53

50
34A
80

32
33
53

80
33
50
43
53

72
71
70

JEWELRY CASE WITH MANY VIEWABLE SPACES AND REMOVABLE SECTIONS

CROSS-REFERENCE TO RELATED APPLICATIONS

This application claims the benefit of U.S. Provisional Patent Application with Ser. No. 62/146,773 filed Apr. 13, 2015 by Pamela B. Riegle and entitled "Jewelry case with many viewable spaces and removable sections called a Jewelry Cube".

FIELD OF INVENTION

This invention relates to a Jewelry case with many viewable spaces and removable sections called a "Jewelry Cube". Particularly this invention pertains to a jewelry storage and display device to handle many necklaces, bracelets, pendants, rings and the like.

FEDERALLY SPONSORED RESEARCH

None.

SEQUENCE LISTING OR PROGRAM

None.

BACKGROUND

Field of Invention and Prior Art

As far as known, there are no Jewelry case with many viewable spaces and removable sections called a "Jewelry Cube" or the like. It is believed that this product is unique in its design and technologies. The problems addressed are shown in the objects and advantages section below.

Prior art related in this field are summarized as follows: A U.S. Pat. No. 3,930,702 was issued in 1976 to John R. Pichowicz and entitled "Hang-it-all jewelry cabinet". This demonstrated a decorative wall cabinet for retaining an assembly of necklaces with or without medallions thereon, chains, both long and short, chains of beads, bracelets, rings and ornamental pins all in visible, convenient arrangement for selection by the wearer. The cabinet has a hinged door with a picture or other decoration on its outer surface and a mirror on its inner surface. A bar is fixed below the mirror having outwardly extending pegs or pins to hang the shorter chains or rings thereon. Inside the cabinet is a row of compartments at the top for bracelets and such jewelry, a bar having pins extending outwardly from the bar to hang long chains or necklaces thereon in spaced individual relationship. At the bottom end are two pivoted drawers having chambers therein to receive smaller items of jewelry such as pins, bars, etc. Another U.S. Pat. No. 4,848,585 was issued in 1989 to Jeffrey Snyder and entitled "Jewelry storage case". Here was taught a jewelry storage case includes three jewelry containing trays for holding a plurality of jewelry items, each tray including a plurality of apertures in the base thereof and at least one tray including a plurality of hooks in the base thereof for removably securing a plurality of jewelry items to the tray; a first cover for covering one outermost tray; a second cover for covering the other outermost tray; upper and lower hinge sections for hingedly securing the three jewelry containing trays together; and hubs on the covers for hingedly securing the covers to the hinge sections and thereby to the trays such that each tray and the first and second covers can pivot with respect to each other. A U.S. Pat. No. 5,511,873 was issued in 1996 to Sharon Mech and entitled "Cabinet for the storage and display of jewelry". In this patent was shown a jewelry cabinet has a generally rectangular housing with a peripheral wall and a rear planar wall and a generally vertically extending middle wall which forms a left compartment and a right compartment within the housing. A left door and right door are pivotally connected to the housing and adapted to close the left compartment and right compartment respectively. A portion of the exterior of one of the doors is mirrored. On the interior of at least of the left and right doors is arranged a plurality of hanging hooks to retain necklaces. Within at least one of the compartments is a plurality of horizontally extending shelves. The shelves have a generally horizontally extending strip for supporting jewelry with at least one of the shelves also having a frontal vertical strip forming a slot for retaining an earring. The middle wall and the vertical wall bordering the compartment are adapted to removably hold the shelves in a vertically separated arrangement A U.S. Pat. No. 5,758,936 was issued in 1998 to Lana J. Baughan and entitled "Jewelry security cabinet". This was a jewelry security cabinet for the storage and display of objects, specifically necklaces, pendants, rings and earrings. It includes a front cover structure and a rear box-type structure. The mounting surface of the rear box-type structure is constructed to hang on a wall or be set recessed into a wall. The outside surface of the front cover structure is constructed to appear like a picture or a mirror. The front cover structure may be larger than the rear box-type structure to enhance the invisibility aspect. The front cover structure and the rear box-type structure are hingedly connected and have a closure for securing the jewelry security cabinet. The inner surfaces have pins and hangers so as to hold selected objects. Within the rear box-type structure are two detachable display cases. One of the cases is hingedly attached, such that it is swingable and easily removable and holds, for example, earrings. The other case may be a slotted ring holder. A further U.S. Pat. No. 6,158,578 was issued in 2000 to Lori Greiner and entitled "Jewelry holder with at least two movable and interchangeable stands". In this patent was shown and taught a jewelry holder with at least two movable and interchangeable stands and a base. The base may be in the form of a box with a slidable drawer in which a ring holder platform may be inserted. The base has a plurality of grooves to receive jewelry stands. The jewelry stands have various configurations to hold earrings, necklaces and bracelets. A U.S. Pat. No. 6,375,018 was issued in 2002 to Gerald Vaughn Clement and entitled "Jewelry support rack". Here was shown and demonstrated an apparatus for the storage and display of articles of jewelry includes a plurality of plastic strips that are disposed in parallel alignment with respect to each other and which each include a pair of spaced apart openings on each end thereof that are adapted for placement over a pair of posts. The pair of posts are disposed in a parallel spaced apart relationship with respect to each other. Each of the plastic strips includes a plurality of fingers that protrude slightly outward and away from the posts and are adapted to receive and to retain an article of jewelry that may be suspended therefrom. The posts are retained in position in a cabinet. The strips are retained in position along the pair of posts unless the strips are acted on by a force which tends to urge them in either direction along the longitudinal length of the pair of posts. The strips may be urged either closer together or further apart to accommodate various sizes of jewelry items. A brace is preferably used to retain the pair of posts in a proper spaced-apart relationship. The cabinet includes a door that is hingedly attached to a rear half and, when closed, is used to protect the jewelry from the elements and also to conceal the jewelry and, if desired, for purposes of transport.

Still another U.S. Pat. No. 6,857,519 was issued in 2005 to Eldon Daetweiler and entitled "Jewelry box with earring booklet and necklace well". This taught a jewelry box has a lower section having a full drawer, a pair of half drawers, and a ring holder. A rear panel forming a necklace well between the rear panel and the drawers of the lower section defines a rear section. A plurality of necklace hangers attached to the rear panel, a top panel forming the top of the box hinges to the rear panel and has a mirror on an inside face so that a user may lift the top panel in hinged connection to the rear panel. An upper section is formed of a pair of doors, a left door and a right door. A right door tray mounts as a bottom face located on the right door holds articles. A left door holds an earring booklet. Another U.S. Pat. No. 6,926,136 was issued in 2005 Sandra Lynch-Bass and was entitled "Jewelry box". Here was shown a jewelry box including a cabinet with an open front and a closed back. A set of inner doors is hingedly secured within the cabinet for selectively providing access to the closed back of the cabinet. A set of outer doors is hingedly secured to the cabinet for selectively closing its open front. A number of hooks are secured to the back of the outer doors for hanging jewelry. A number of resilient strips are affixed to the front of the inner doors. The resilient strips and the inner doors are perforated for the passage of earring posts. Another U.S. Pat. No. 7,182,416 was issued in 2007 to Lori Greiner and entitled "Jewelry organizer". Here Greiner showed a jewelry organizer for storing a plurality of types of jewelry. The organizer may have pivoting cabinets in which earring, necklace and bracelet stands may be located. Additionally, accessory poles may also be provided. The organizer is versatile because it is configurable to a user's needs.

A U.S. Pat. No. 7,651,178 was issued in 2010 to Lori Greiner and entitled "Jewelry cabinet". She showed a jewelry storage system for storing and allowing access to and removal of jewelry pieces includes a jewelry cabinet and a stand. The jewelry cabinet defines an interior space for holding jewelry items. The jewelry cabinet includes a box frame and a door connected to the box frame wherein the door extends substantially from the top wall to the bottom wall. A plurality of jewelry storage elements are attached within the interior space. In one embodiment, a stand is configured to receive the jewelry cabinet to hold the jewelry cabinet in an upright position so that the back wall of the jewelry cabinet forms an angle from the horizontal. A U.S. Pat. No. 7,806,255 was issued in 2010 to Henrietta B Staver and entitled "Jewelry display". This one demonstrated a jewelry display for ease and convenience having a front frame hingedly connected to a rear compartment. The front frame includes a mirror and screen which can be opened for retrieval or storage of jewelry or other small objects on a series of shelves, slots and posts mounted in the rear compartment. A pair of magnets maintains the front frame in a closed posture with the rear compartment. Hooks are also available for jewelry suspension on the front of the frame beneath the screened mirror. When the jewelry display is closed, the mirror in the front frame allows the user to observe the jewelry worn and the screen permits a convenient attachment of jewelry during dressing. Another U.S. Pat. No. 8,029,076 was issued in 2011 to Lori Greiner again and entitled "Jewelry cabinet". Here was taught a jewelry storage system for storing and allowing access to and removal of jewelry pieces includes a jewelry cabinet and a stand. The jewelry cabinet defines an interior space for holding jewelry items. The jewelry cabinet includes a box frame and a door connected to the box frame wherein the door extends substantially from the top wall to the bottom wall. A plurality of jewelry storage elements are attached within the interior space. In one embodiment, a stand is configured to receive the jewelry cabinet to hold the jewelry cabinet in an upright position so that the back wall of the jewelry cabinet forms an angle from the horizontal.

Still another U.S. Patent Application 20070164643 was submitted in 2007 by again Lori Greiner and entitled "Vanity organizer system". This taught an organizer system includes an interior space defined by a frame, the frame including a first sidewall, a second sidewall, a back wall, a top wall and a bottom wall; the top wall and the bottom wall each include a right segment and a left segment. The system further includes a first door connected to the frame and extending substantially from the top left wall segment to the bottom left wall segment and a second door connected to the frame and extending substantially from the top right wall segment to the bottom left wall segment; each door further defines the interior space and opens outward from the interior space. At least one storage element is disposed within the interior space. A U.S. Patent Application 20120181191 was submitted in 2012 by Jonna Harris-Bowman and entitled "Jewelry Organization, Storage, and Transportation Assemblies and Methods". In this application was demonstrated a jewelry support assemblies are provided that can include a substantially planar base portion having a member extending therefrom, the member including a plurality of openings; a plurality of arms extending from the openings, individuals ones of the arms being associated with individual ones of the openings; and a plurality of rods extending from the arms, the rods being staggered along the length of the arms. Other assemblies are also provided that include: a rod extending from a first end to a second end; flexible material at least partially wrapping the rod and extending therefrom, the material including multiple layers of overlapping material; and wherein exposed overlapping portions of material include openings. Jewelry storage assemblies are provided that can include: a case comprising at least two components configured to be coupled when in a closed position; and one of the two components configured to house a jewelry support assembly. In another U.S. Patent Application 20110315567 was submitted in 2011 by Joanna Boynton et al. and entitled "Customizable Storage Container System". It showed a series of interlocking or non-interlocking stackable containers have an identical size and shape. The containers may include transparent sides and a transparent cover. The cover may include a raised area. The bottom of container may include an inward recess sized to accept the raised area of the cover of a lower container. Each container may include an interchangeable faceplate that affixes to the transparent cover. The interchangeable faceplate may be used to accessorize the containers for visual recognition and cover an outer area of the cover, leaving an inner area of the cover exposed for viewing contents. The transparent cover may have a downwardly extending lip that snaps onto a protrusion on a container base. The faceplate may cover both horizontal and vertical surfaces of the cover. The cover may have a depressed perimeter configured to accept the faceplate. An insert may be provided that holds contents in place.

Another U.S. Patent Application 20120223626 was submitted in 2012 by Vicky Thomas and entitled "Fashion Accessory Internal Door Storage Cavity". Here was shown a storage device mounted within a door frame is disclosed for storage and organization of fashion accessories or similar articles. The device comprises a door having an internal cutout, wherein an internal cavity is provided for storage of articles in a condensed space, which can be accessed via a second, cutout door. A full length mirror is mounted to the interior of the second door along with peg board to allow attachment of accessory hooks for hanging items. One or more hinged panels inside of the interior cavity provide separation of the internal cavity and increased surface area to allow attachment of additional hooks or attachment means. The back wall of the interior cavity also provides a location for further hooks and shelving for storage. The device may be provided within the interior of a larger door, or as a door insert adapted to be incorporated into an existing door. There is a European Patent Application EP1810591 submitted in 2007 by Lori Greiner and entitled "Vanity organizer system". Here is demonstrated an organizer system that includes an interior space defined by a frame, the frame including a first sidewall, a second sidewall, a back wall, a top wall and a bottom wall; the top wall and the bottom wall each include a right segment and a left segment. The system further includes a first door connected to the frame and extending substantially from the top left wall segment to the bottom left wall segment and a second door connected to the frame and extending substantially from the top right wall segment to the bottom left wall segment; each door further defines the interior space and opens outward from the interior space. At least one storage element is disposed within the interior space. None of these prior art examples that were found anticipate or suggest as obvious the Jewelry case with many viewable spaces and removable sections called a "Jewelry Cube" provided herein.

SUMMARY OF THE INVENTION

This invention is a Jewelry case with many viewable spaces and removable sections called a "Jewelry Cube". This pertains to a jewelry storage and display device to handle many necklaces, bracelets, pendants, rings and the like.

The preferred embodiments of the Jewelry case with many viewable spaces and removable sections called a "Jewelry Cube" is comprised as follows: A Jewelry storage and display case called a jewelry cube essentially made of durable and transparent plastic and comprising: a top surface with a hinging means connected pivotally to a back surface; a bottom surface; a front surface; an end surfaces with apertures for encircling multiple pull out racks, the pullout racks having end faces, finger apertures and a means for controlling and containing the pullout within the aperture of the end sections and cube; a main set of jewelry hook assembly for the jewelry container, storage and display device, the assembly further comprised of many individual hooks; a container and cubicle drawer for rings, pins, broaches, etc.; a crate structures with separators between crate structures; and a rotatable turn table (under bottom surface) with a means for removably attaching turn table to bottom surface wherein the cube may be filled with jewelry for display and storage of the jewelry.

The newly invented Jewelry case with many viewable spaces and removable sections called a "Jewelry Cube" may be manufactured at low volumes by very simple means and in high volume production by more complex and controlled systems.

Objects and Advantages

There are several objects and advantages of the Jewelry case with many viewable spaces and removable sections called a "Jewelry Cube". There are currently no known improvements jewelry storage and display industry that are effective at providing the objects of this invention.

The Jewelry case with many viewable spaces and removable sections called a "Jewelry Cube" have the following advantages:

| Item | Advantages |
|---|---|
| 1 | Maximize storage with a minimal footprint (Space) |
| 2 | Minimizes tangled jewelry |
| 3 | Accepts virtually all lengths of necklaces |
| 4 | Is a simple design |
| 5 | Uses available materials |
| 6 | Displays jewelry with transparent surfaces |
| 7 | Provides easy access to jewelry with pullout sections |
| 8 | Plethora of hooks and cubicles |
| 9 | Protects jewelry from dust |
| 10 | Provides a jewelry organizer |
| 11 | Provides easy to assemble or reassemble with releasable securing means between components |
| 12 | Provides a flat, knock-down components package for easy and economical shipping, gifting and storage |

Finally, other advantages and additional features of the present Jewelry case with many viewable spaces and removable sections called a "Jewelry Cube" devices will be more apparent from the accompanying drawings and from the full description of the device. For one skilled in the art of jewelry storage and display, it is readily understood that the features shown in the examples with this product are readily adapted to other types of storage, display and handling systems and devices.

DESCRIPTION OF THE DRAWINGS—FIGURES

The accompanying drawings, which are incorporated in and constitute a part of this specification, illustrate an embodiment of the Jewelry case with many viewable spaces and removable sections called a "Jewelry Cube" devices that is preferred. The drawings together with the summary description given above and a detailed description given below serve to explain the principles of the Jewelry case with many viewable spaces and removable sections called a "Jewelry Cube". It is understood, however, that the Jewelry case with many viewable spaces and removable sections called a "Jewelry Cube" device is not limited to only the precise arrangements and instrumentalities shown.

FIGS. 1 A through 1 D are sketches of the general jewelry container, storage and display device including mock-up prototype and first production model.

FIG. 2 is a sketch of the jewelry container storage and display device called a jewelry cube with many components and features noted.

FIG. 3 is a sketch of the first production unit of the jewelry container, storage and display device with components and features shown from generally a side view.

FIGS. 4 A through 4 C are sketches of main hook assembly and a pull out rack for the jewelry container storage and display device and alternative hook assemblies.

FIG. 5 is a sketch of the top container and cubicle drawer for the jewelry container storage and display device with components and features denoted.

FIGS. 6 A through 6 G are sketches of the jewelry container, storage and display device as the original mock-up device.

FIG. 7 A through 7 C are sketches of the jewelry storage container and display, device in use.

DESCRIPTION OF THE DRAWINGS

REFERENCE NUMERALS

Figure 1B:
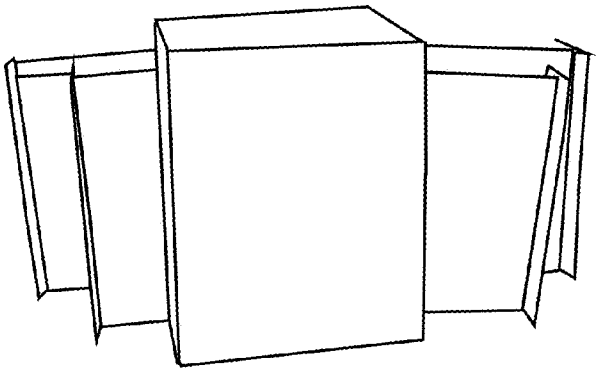
Figure 1D:
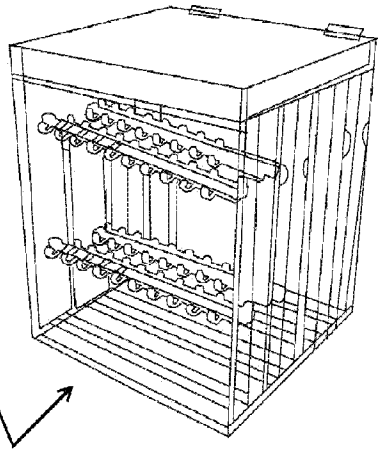
Figure 1A:
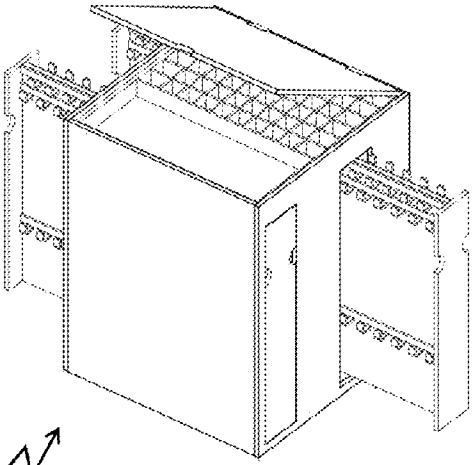
Figure 1C:
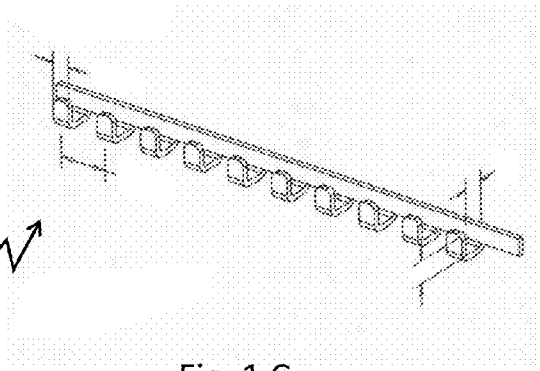

The following list refers to the drawings Reference numbers:

| Ref # | Description |
|---|---|
| 30 | Jewelry storage and pull out racks called a jewelry cube 30 |
| 31 | Top surface 30 |
| 32 | Hinges 32 (metal, plastic, acrylic, leather, fabric or equal) to attach top surface 31 to back surface 33A with releasable screws or adhesive tapes or the like |
| 33 | Front surface 33 with slots or configured shapes to accept contiguous surfaces |
| 33A | Back surface 33A with slots or configured shapes to accept contiguous surfaces |
| 34 | End surfaces 34 (around pull out racks) with slots or configured shapes to accept contiguous surfaces |
| 34A | Apertures 34A in the end surface to receive the pullout racks 50 |
| 35 | Bottom surface 35 with slots or configured shapes to accept contiguous surfaces |
| 40 | Main set of jewelry hook assembly 40 for the jewelry container, storage and display device 30 |
| 40A | Alternative hook assembly 40A |
| 42 | Means for attaching 42 hook assembly 40 to pull out rack 50 center wall 53 such as but not limited to threaded fasteners, adhesive, rivets, pins, integral molding, heat weld or equal |
| 43 | Individual hook 43 |
| 44 | Width 44 between hooks 43 |
| 45 | Length 45 of hook assembly 45 |
| 46 | Thickness 46 of hook assembly 40 |
| 47 | Individual/single hook J width 47 |
| 48 | Corner tabs 48 to secure side surface 33 to end surface 34 |
| 50 | Pull out rack 50 for the jewelry container, storage and display device 30 |
| 51 | End face 51 of pull out rack 50 with slots or configured shapes to accept center wall 53 |
| 52 | Aperture 52 (finger slots) |
| 53 | Center 53 wall of pull out rack 50 |
| 54 | Height 54 of pull out rack 50 |
| 55 | Width 55 of pull-out 50 |
| 56 | Width 56 of pull out end face 51 |
| 57 | Means 57 for controlling and containing the pullout 50 within the aperture 34A of the end surface 34 and cube 30 - such as slides, clips, support rails with resistance (rough surface or felt or Velcro RTM -like materials or similar means) |
| 70 | Container and cubicle drawer 70 for rings, pins, broaches, etc. |
| 71 | Clearance 71 for larger items |
| 72 | Crate structures 72 with slots or configured shapes to accept separators 73 |
| 73 | Separators 73 between crate structures 72 |
| LG | Longitudinal crate structure length LG and clearance for LG+ |
| LT | Lateral crate structure width LT and clearance for LT+ |
| 80 | Original jewelry cube mock up 80 |
| 90 | First production model 90 of the jewelry cube 30 |
| 100 | Turn table 100 (under bottom surface 35) |
| 101 | Means for removably attaching 101 turn table 100 to bottom surface 35 such as screws, adhesive tape, or equal |
| 120 | Jewelry 120 |

DETAILED DESCRIPTION OF PREFERRED EMBODIMENT

The present development is a Jewelry case with many viewable spaces and removable sections called a "Jewelry Cube". This invention relates particularly to a Jewelry case with many viewable spaces and removable sections called a "Jewelry Cube". Particularly this invention pertains to a jewelry storage and display device to handle many necklaces, bracelets, pendants, rings and the like.

The advantages for the Jewelry case with many viewable spaces and removable sections called a "Jewelry Cube" are listed above in the introduction. Succinctly the benefits are that the device:

A. Maximize storage with a minimal footprint (Space)
B. Minimizes tangled jewelry
C. Accepts virtually all lengths of necklaces
D. Is a simple design
E. Uses available materials
F. Displays jewelry with transparent surfaces
G. Provides easy access to jewelry with pullout sections
H. Plethora of hooks and cubicles
I. Protects jewelry from dust
J. Provides a jewelry organizer
K. Provides a flat, knock-down components package for easy and economical shipping, gifting and storage
L. Provides a flat, knock-down components package for easy and economical shipping, gifting and storage The preferred embodiments of the Jewelry case with many viewable spaces and removable sections called a "Jewelry Cube" is comprised as follows: A Jewelry storage and display case 30 called a jewelry cube essentially made of durable and transparent plastic and comprising: a top surface 31 with a hinging means 32 connected pivotally to a back surface 34A; a bottom surface 35; a front surface 33; a pair of end surfaces 34 with apertures 34A for encircling multiple pull out racks 50, the pullout racks having end faces 51, finger apertures 52 and a means 57 for controlling and containing the pullout 50 within the aperture 34A of the end sections 34 and cube 30; a main set of jewelry hook assembly 40 for the jewelry container, storage and display device, the assembly 40 further comprised of many individual hooks 43; a container and cubicle drawer for rings, pins, broaches, etc. 70; a crate structures 72 with separators 73 between crate structures 73; and a rotatable turn table 100 (under bottom surface 35) with a means for removably attaching turn table to bottom surface 101 wherein the cube 30 may be filled with jewelry 120 for display and storage of the jewelry. Hinging means 32 may be metal, plastic, acrylic, leather, fabric or equal.

There is shown in FIGS. 1-7 a complete description and operative embodiment of the Jewelry case storage and display device called a "Jewelry Cube". In the drawings and illustrations, one notes well that the FIGS. 1-7 demonstrate the general configuration and use of this product.

The accompanying drawings, which are incorporated in and constitute a part of this specification, illustrate an embodiment of the Jewelry case storage and display device. The drawings together with the summary description given above and a detailed description given below serve to explain the principles of the "Jewelry Cube" and its component parts. It is understood, however, that the improved Jewelry case storage and display devices are not limited to only the precise arrangements and instrumentalities shown. Other examples of jewelry storage and display devices and uses are still understood by one skilled in the art of jewelry storage and display devices to be within the scope and spirit shown here.

FIGS. 1 A through 1 D are sketches of the general jewelry container 30, storage and display device including mock-up prototype and first production model. Shown here are: jewelry storage and pull out racks called a jewelry cube 30; main set of jewelry hook assembly 40 for the jewelry container, storage and display device 30; original jewelry cube mock up 80; and first production model of the jewelry cube 90.

Figure 2:
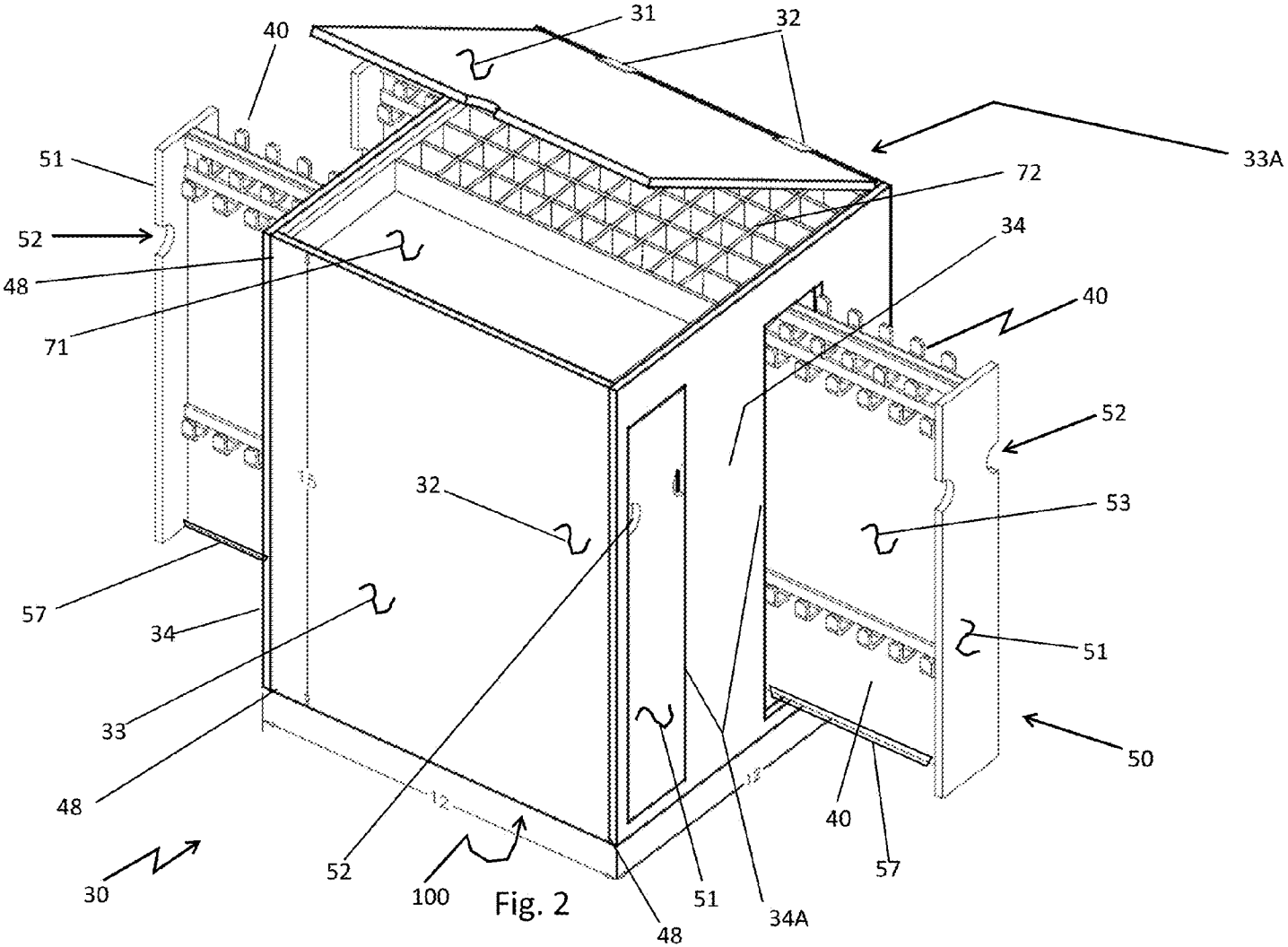

FIG. 2 is a sketch of the jewelry container storage and display device called a jewelry cube with many components and features noted. The major material of the components is a durable transparent or translucent (smoky or tinted) acrylic plastic, Lexan®, composite material or the like. Shown in this sketch are: the jewelry storage and pull out racks called a jewelry cube 30; a top surface 31; the hinges 32 to attach top surface 31 to back surface 33A with releasable screws or adhesive tapes or the like; a front surface 33 with slots or configured shapes to accept center wall 53; a back surface 33A with slots or configured shapes to accept contiguous surfaces; the end surfaces (around pull out racks) 34 with slots or configured shapes to accept contiguous surfaces; apertures 34A in the end surface to receive the pullout racks 50; a main set of jewelry hook assembly 40 for the jewelry container, storage and display device 30; the pull out rack for the jewelry container, storage and display device 50; the end face of pull out rack 51 with slots or configured shapes to accept center wall 53; aperture (finger slots) 52; a center wall of pull out rack 53; means 57 for controlling and containing the pullout 50 within the aperture 34A of the end sections 34 and cube 30—such as slides, clips, support rails with resistance (rough surface or felt or Velcro®-like materials or similar means); container and cubicle drawer 70 for rings, pins, broaches, etc. 120; a clearance area for larger items 71; crate structures 72 with slots or configured shapes to accept separators 73; separators between crate structures 73; and optional corner tabs 48 to secure side surfaces 33 to end surfaces 34.

Figure 3:
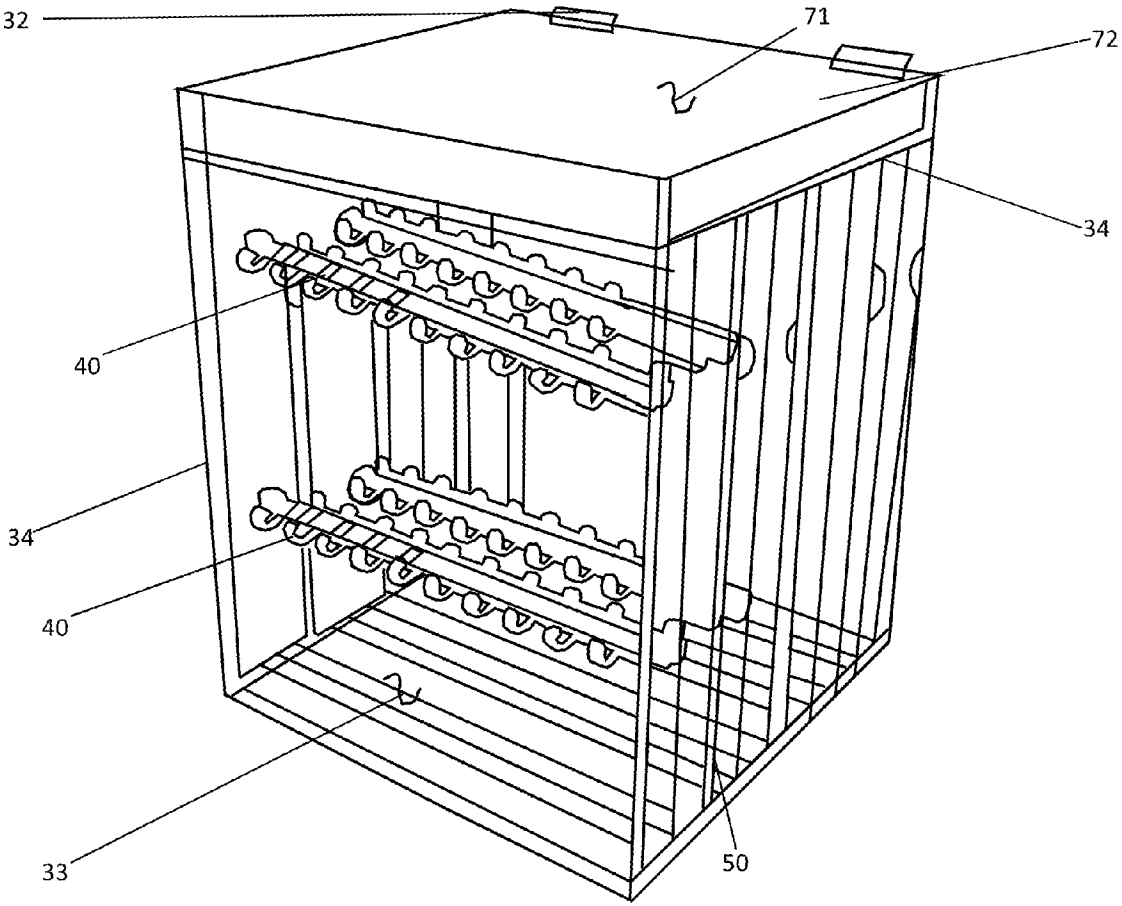

FIG. 3 is a sketch of the first production unit of the jewelry container, storage and display device 30 with components and features shown from generally a side view. Features shown are described above in FIG. 2.

Figure 4B:
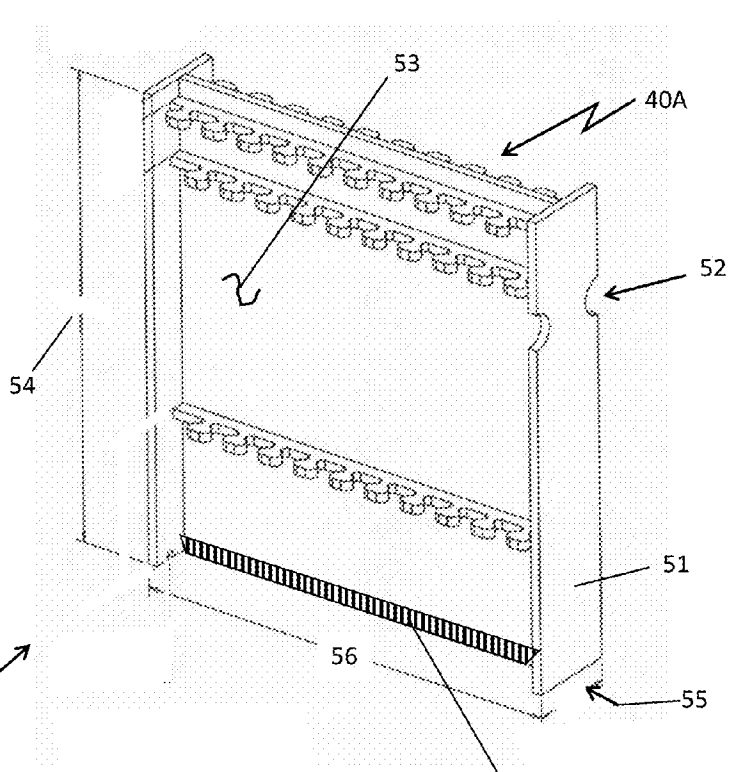
Figure 4A:
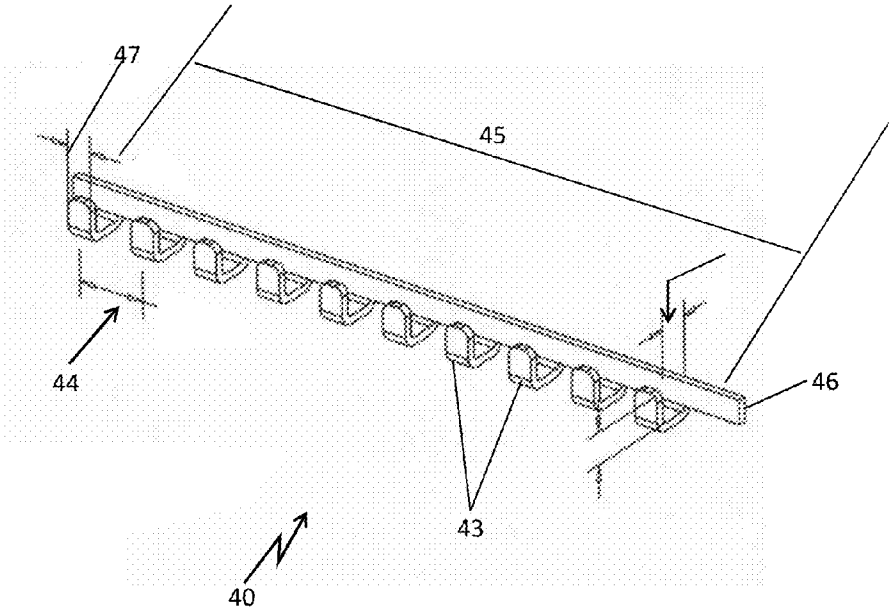
Figure 4C:
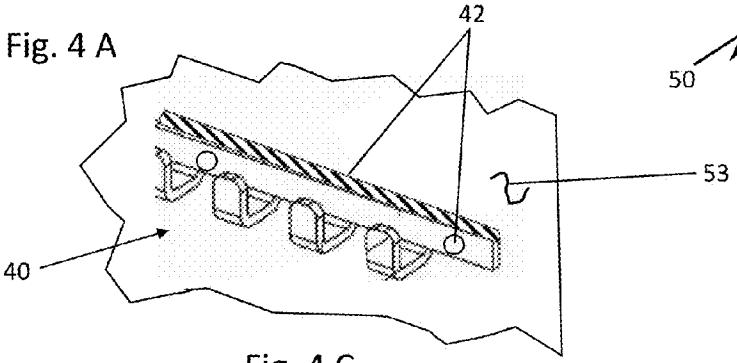

FIGS. 4 A through 4 C are sketches of main hook assembly and a pull out rack for the jewelry container storage and display device 30 and alternative hook assemblies 40,40A. Demonstrated in these vies are: main set of jewelry hook assembly 40 for the jewelry container, storage and display device 30; alternative hook assembly 40A; individual hook 43; width between hooks 44; length of hook assembly 45; thickness of hook assembly 46; individual/single hook J width 47; pull out rack for the jewelry container, storage and display device 50; end face of pull out rack 51; aperture (finger slots) 52; center wall of pull out rack 53; height of pull out 54; width of pull out 55; and width of pull out end face 56. One notes that the hook assembly 40 or alternative 40A may be the clear acrylic or special composite material as the cube 30 or an alternative durable material such as a metal (polished steel alloy, plated steel, aluminum, stainless steel or the like) or another composite material (plastic, acrylic, nylon or equal). FIG. 4 C shows the hook assembly 40 secured to the center wall 53 of the pull out section 50. Here there is a removable or non-removable means 42 to attach or secure the assembly 40 or 40A to the center. That means 42 is a means for attaching 42 hook assembly 40 to pull out rack 50 center wall 53 such as but not limited to threaded fasteners, adhesive, rivets, pins, integral molding, heat weld or equal.

Figure 5:
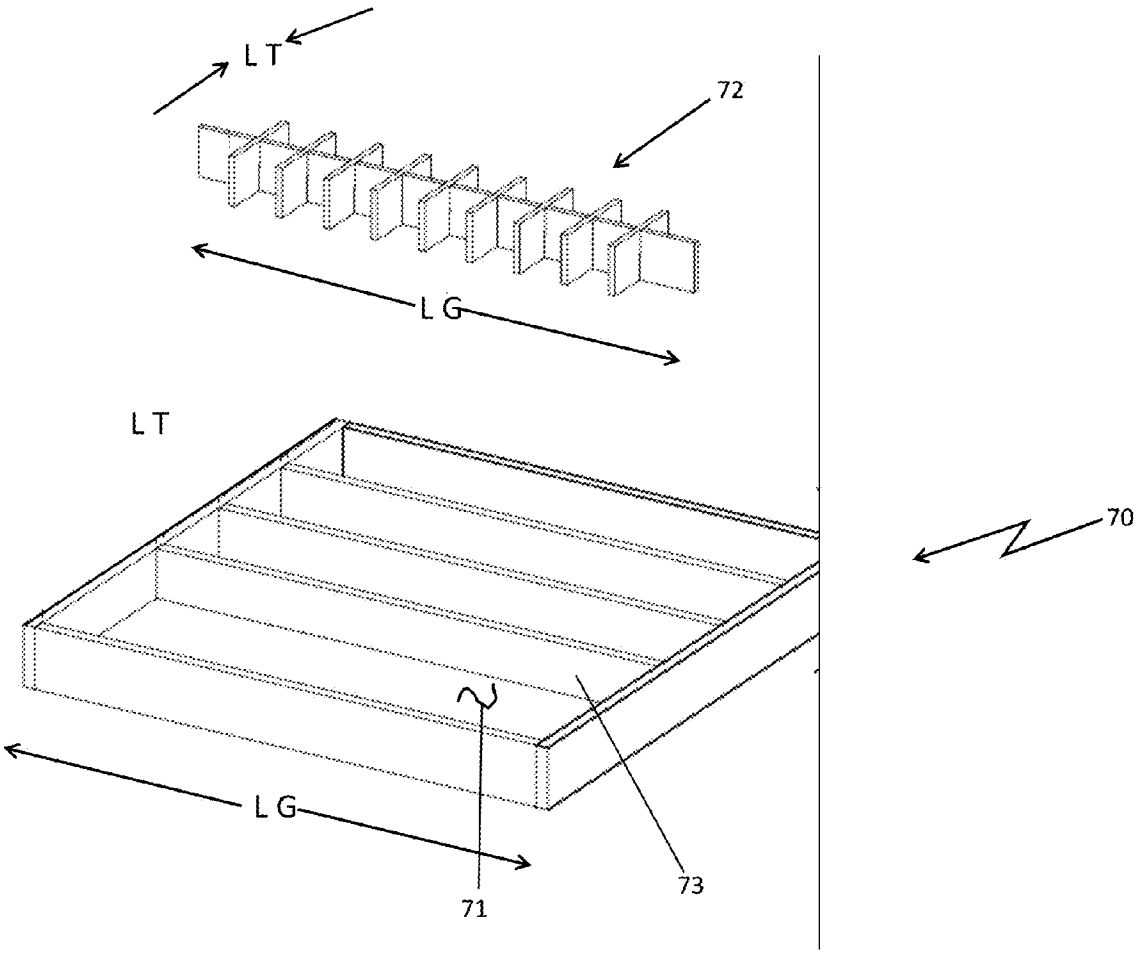

FIG. 5 is a sketch of the top container and cubicle drawer for the jewelry container storage and display device 30 with components and features denoted. In these views are shown: a container and cubicle drawer for rings, pins, broaches, etc. 70; clearance for larger items 71; crate structures 72 with slots or configured shapes to accept separators 73; separators between crate structures 73; longitudinal crate structure LG, and clearance for LG, LG+; and lateral crate structure LT clearance for LT, LT+.

Figures 6A, 6B, 6C, 6D, 6E, 6F, 6G:
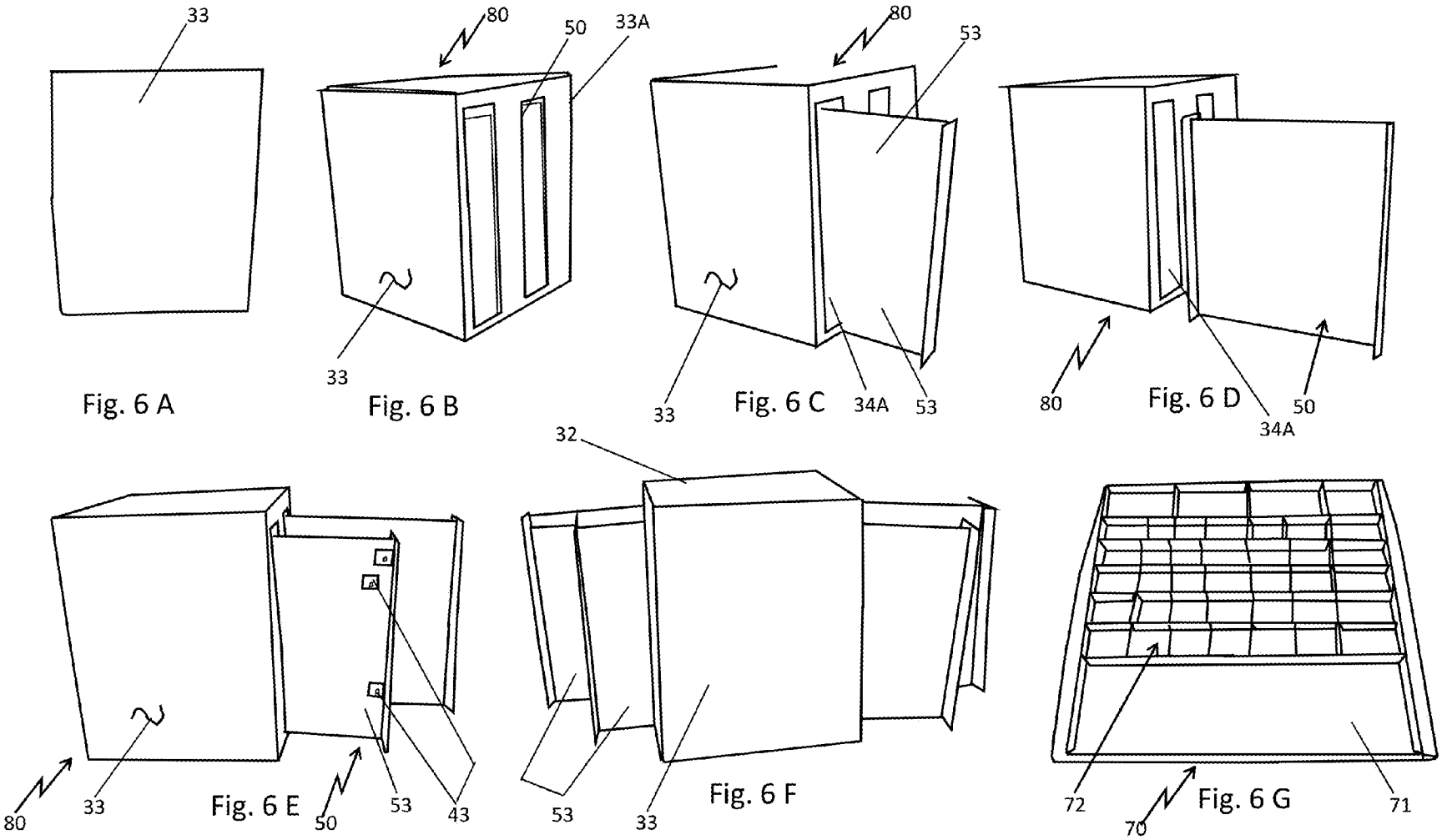

FIGS. 6 A through 6 G are sketches of the jewelry container, storage and display device as the original mock-up device. The components and features are marked and referred as described above in paragraph [0026].

Figure 7C:
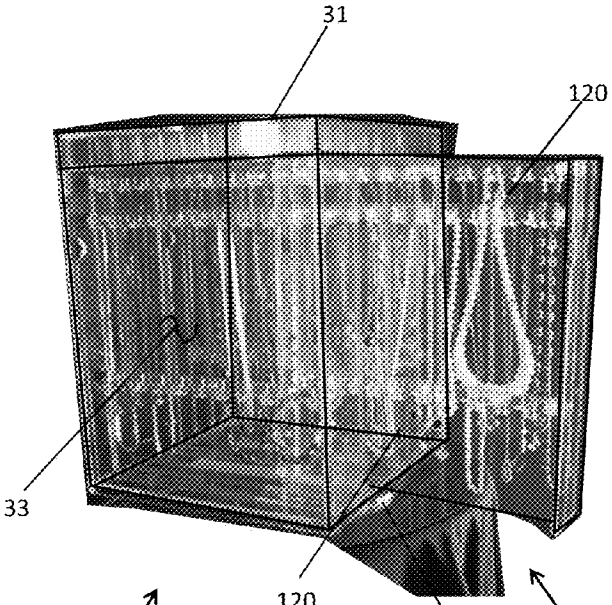
Figure 7B:
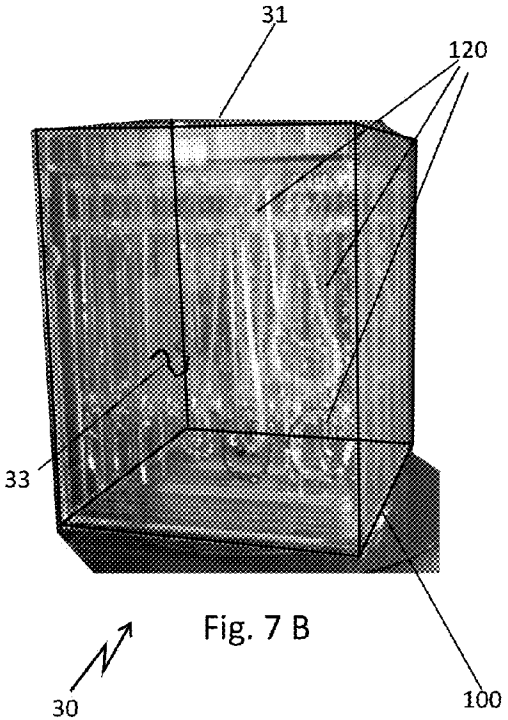
Figure 7A:
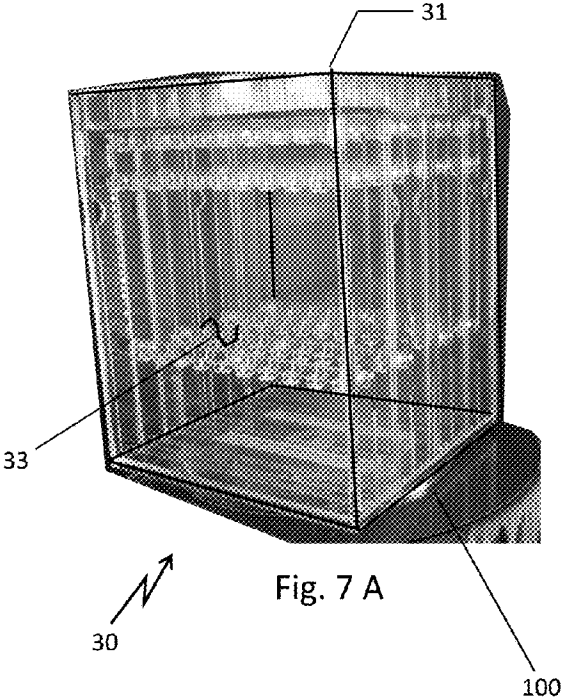

FIG. 7 A through 7 C are sketches of the jewelry storage container and display, device in use. These are described below.

The details mentioned here are exemplary and not limiting. Other specific components and manners specific to describing a Jewelry case storage and display device 30 may be added as a person having ordinary skill in the field of jewelry display and storage devices and their uses well appreciates.

Operation of the Preferred Embodiment

The Jewelry case device 30 with many viewable spaces and removable sections called a "Jewelry Cube" has been described in the above embodiment. The manner of how the device operates is described below. One notes well that the description above and the operation described here must be taken together to fully illustrate the concept of the Jewelry case device 30 with many viewable spaces and removable sections called a "Jewelry Cube".

The preferred embodiments of the Jewelry case with many viewable spaces and removable sections called a "Jewelry Cube" is comprised as follows: A Jewelry storage and display case 30 called a jewelry cube essentially made of durable and transparent plastic and comprising: a top surface 31 with a hinging means 32 connected pivotally to a back surface 34A; a bottom surface 35; a front surface 33; a pair of end surfaces 34 with apertures 34A for encircling multiple pull out racks 50, the pullout racks having end faces 51, finger apertures 52 and a means 57 for controlling and containing the pullout 50 within the aperture 34A of the end sections 34 and cube 30; a main set of jewelry hook assembly 40 for the jewelry container, storage and display device 30, the hook assembly 40 further comprised of many individual hooks 43; a container and cubicle drawer for rings, pins, broaches, etc. 70; a crate structures 72 with separators 73 between crate structures 73; and a rotatable turn table 100 (under bottom surface 35) with a means for attaching turn table to bottom surface 101 wherein the cube 30 may be filled with jewelry 120 for display and storage of the jewelry.

The Jewelry case with many viewable spaces and removable sections called a "Jewelry Cube." operates somewhat similar to other jewelry storage and display cases. The jewelry is separates and classified/distinguished by the operator. Then the various necklaces, bracelets, pendants and rings are placed on the hooks or in the storage cubical/crate areas for storage and display.

FIG. 7 A through 7 C are sketches of the jewelry storage container and display, device in use. Shown here is the Jewelry storage and pull out racks called a jewelry cube 30; top surface 31; front surface 33; pull out rack for the jewelry container, storage and display device 50; turn table 100 (under bottom surface 35 and jewelry 120. As one may interpret, the empty jewelry cube 30 starts in FIG. 7 A as empty, yet ready for the various types of jewelry 120. Then, in FIG. 7 B, the operator or owner selects the jewelry 120 and places/populates the cube 30 by placing the jewelry 120 on the individual hooks 43 of the pullout section 50. Also, the operator may place rings, pendants, braches or bracelets in the crate structure 71 of the top section 70. During this placement of the jewelry 120, the operator may select color, gem type, size, or other types of characterization to populate the pullouts 50 and crates 71. Once the jewelry 120 is placed, the pullouts 50 and top 31 are closed as shown in FIG. 7 C. Here the jewelry is organize yet clearly shown in the jewelry cube 30 as a transparent display unit.

Many uses are anticipated for the Jewelry case device 30 with many viewable spaces and removable sections called a "Jewelry Cube". Some examples, and not limitations, are shown in the following Table.

| Item | Uses |
|---|---|
| 1 | Storage and display of necklaces |
| 2 | Storage and display of rings, pins, and broaches |
| 3 | Storage and display of bracelets and hoops |
| 4 | Protective covering for jewelry |
| 5 | Organizer for jewelry |

With this description it is to be understood that the Jewelry case device 30 is not to be limited to only the disclosed embodiment of product. The features of the special Jewelry case device with many viewable spaces and removable sections are intended to cover various modifications and equivalent arrangements included within the spirit and scope of the description.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention for it to be encompassed by the present claims. Furthermore, no element, component, or method step in the present disclosure is intended to be dedicated to the public regardless of whether the element, component, or method step is explicitly recited in the claims.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed is:

1. A jewelry storage and display case (30) comprising: a top surface (31) with a hinging means (32) connected pivotally to a back surface (33A); a bottom surface (35); a front surface (33); a pair of end surfaces (34), each end surface including apertures (34A), each aperture encircling a pull out rack (50), each pullout rack having a center wall (53), a pair of end faces (51) with a finger aperture (52) and a means (57) for controlling and containing the pullout rack (50) within the respective aperture (34A) of the respective end surface (34); at least one pull out rack including a jewelry hook assembly (40) comprised of many individual hooks (43); a container for rings, pins, and broaches located under the top surface, the container including crate structures (72) with separators (73) between crate structures (73); and a rotatable turn table (100) interposed under the bottom surface (35) with a removable means (101) for attaching the turn table (100) to the bottom surface (35); wherein the storage and display case (30) can be filled with jewelry (120); wherein the end surfaces and front surface are made out of transparent plastic material.

2. The jewelry storage and display case (30) according to claim 1, wherein the plastic material is selected from the group consisting of translucent acrylic plastic, Lexan RTM, and composite material.

3. The jewelry storage and display case (30) according to claim 1, wherein the jewelry hook assembly 40 is selected from the group consisting of acrylic, composite material and metal.

4. The jewelry storage and display case (30) according to claim 3, wherein the metal is selected from the group consisting of polished steel alloy, plated steel, aluminum, and stainless steel.

5. The jewelry storage and display case (30) according to claim 3, wherein the composite material is selected from the group consisting of plastic, acrylic, and nylon.

6. The jewelry storage and display case (30) according to claim 1, further comprised of a means for attaching the jewelry hook assembly (40) to the center walls (50).

7. The jewelry storage and display case (30) according to claim 6, wherein the means for attaching (42) the jewelry hook assembly (40) is selected from the group consisting of a threaded fasteners, an adhesive, a set of rivets, a plurality of pins, an integral molding, and a heat weld.

* * * * *